US006883878B2

(12) United States Patent
Gorelick

(10) Patent No.: US 6,883,878 B2
(45) Date of Patent: Apr. 26, 2005

(54) MODULAR FURNITURE ASSEMBLY

(76) Inventor: Tracei Gorelick, 630 Vaughn Rd., Bloomfield Hills, MI (US) 48304-2663

( * ) Notice: Subject to any disclaimer, the term of this patent is extended or adjusted under 35 U.S.C. 154(b) by 63 days.

(21) Appl. No.: 10/264,980

(22) Filed: Oct. 4, 2002

(65) Prior Publication Data

US 2003/0141789 A1 Jul. 31, 2003

Related U.S. Application Data

(60) Provisional application No. 60/327,452, filed on Oct. 5, 2001.

(51) Int. Cl.[7] ..... A47B 7/02

(52) U.S. Cl. ..... 312/108; 312/235.4; 297/17

(58) Field of Search ..... 312/108, 111, 312/235.4, 241, 240; 108/11, 14, 50.11; 297/16.1, 17, 52, 53, 440.14, 440.1

(56) References Cited

U.S. PATENT DOCUMENTS

| | | | | | |
|---|---|---|---|---|---|
| 415,371 | A | * | 11/1889 | Smith | 312/230 |
| 1,002,937 | A | * | 9/1911 | Spade | 190/12 A |
| 1,659,840 | A | * | 2/1928 | Smith | 190/12 A |
| 2,381,464 | A | * | 8/1945 | Rosenthal | 312/259 |
| 2,659,642 | A | * | 11/1953 | Records | 312/235.3 |
| 3,674,306 | A | * | 7/1972 | Botney | 297/17 |
| 3,834,776 | A | * | 9/1974 | Becker, Jr. | 312/108 |
| 4,050,736 | A | * | 9/1977 | Karp | 297/135 |
| 4,223,945 | A | * | 9/1980 | Nikitits | 297/158.4 |
| 5,074,619 | A | * | 12/1991 | D'Orsi et al. | 297/236 |
| 5,383,721 | A | * | 1/1995 | Thomas | 312/7.2 |
| 5,685,600 | A | * | 11/1997 | Kuo | 297/157.1 |
| 5,810,430 | A | * | 9/1998 | Bryjak et al. | 297/17 |
| 5,967,600 | A | * | 10/1999 | Jelacic et al. | 297/142 |
| 6,068,331 | A | * | 5/2000 | Barnes | 297/140 |
| 6,216,410 | B1 | * | 4/2001 | Haberman | 52/591.1 |

FOREIGN PATENT DOCUMENTS

| | | | | |
|---|---|---|---|---|
| GB | 1466494 | * | 3/1977 | 108/91 |

* cited by examiner

*Primary Examiner*—Janet M. Wilkens
(74) *Attorney, Agent, or Firm*—Rader, Fishman & Grauer, PLLC

(57) ABSTRACT

A modular furniture assembly includes at least one first component and a second component. The second component includes a cavity. The at least one first component and the second component are adaptable to be stowed in a compact stowed position such that the modular furniture assembly forms a geometric shape when in the stowed position. A method for forming a furniture assembly is also disclosed. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

6 Claims, 10 Drawing Sheets

MODULAR FURNITURE ASSEMBLY

CLAIM TO PRIORITY

This application claims the benefit of U.S. Provisional Application No. 60/327,452, filed Oct. 5, 2001, the entire contents are incorporated herein by reference.

TECHNICAL FIELD

The present invention relates to furniture, and in particular to a modular furniture assembly that forms a compact, geometric shape when in a stowed position.

SUMMARY OF THE INVENTION

The present invention is directed to a modular furniture assembly comprising at least one first component and a second component. The second component includes a cavity. The at least one first component and the second component are adaptable to be stowed in a compact position such that the modular furniture assembly forms a geometric shape when in the compact position.

Another embodiment of the invention is directed to a method for forming a modular furniture assembly. The method comprises the steps of locking one or more first components in a stowed position, and nesting a second component within the one or more first components, whereby the furniture assembly forms a geometric shape.

Another embodiment of the invention is directed to a modular furniture assembly including at least one chair and a table. The modular furniture assembly comprises at least one chair, and a table including a cavity, wherein the at least one chair and the table are adaptable to be stowed in a compact position such that the modular furniture assembly forms a geometric shape when in the compact position.

DESCRIPTION OF THE PREFERRED EMBODIMENT

Figure 1:
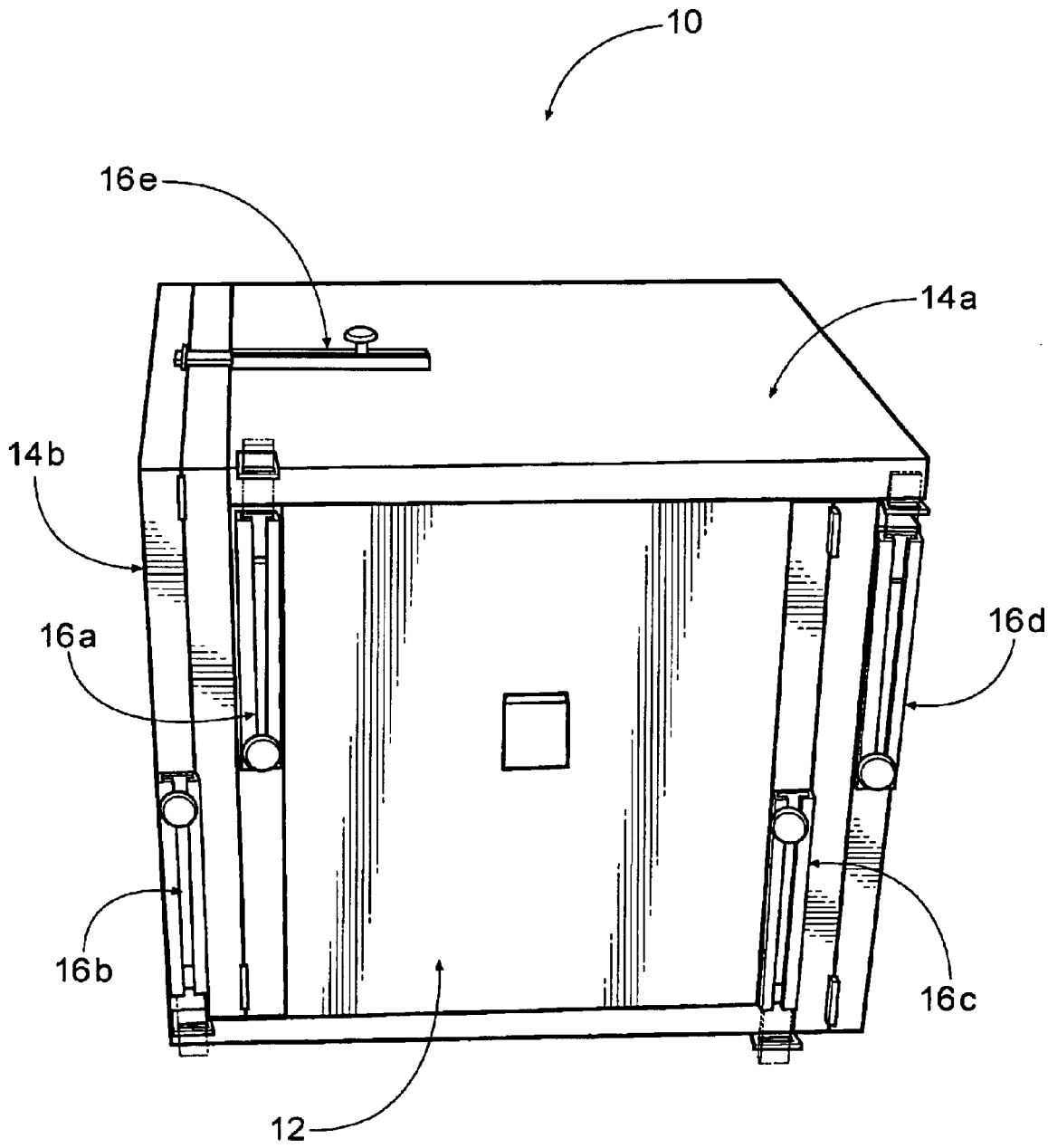
FIG. 1 is a perspective view of a first embodiment of a modular furniture assembly in a stowed position.

FIGS. 1–9 illustrate a furniture assembly according to one embodiment of the invention. Referring to FIG. 1, the modular furniture assembly, which is shown generally at 10, forms a geometric shape, such as a cube, when a table 12 and chairs 14*a*, 14*b* are locked together by locking means, such as surface bolts 16*a*–16*e*. Although only five surface bolts 16*a*–16*e* are shown in the illustrated view according to FIG. 1, any desirable amount of surface bolts may be included in the design of the furniture assembly 10.

Figure 2:
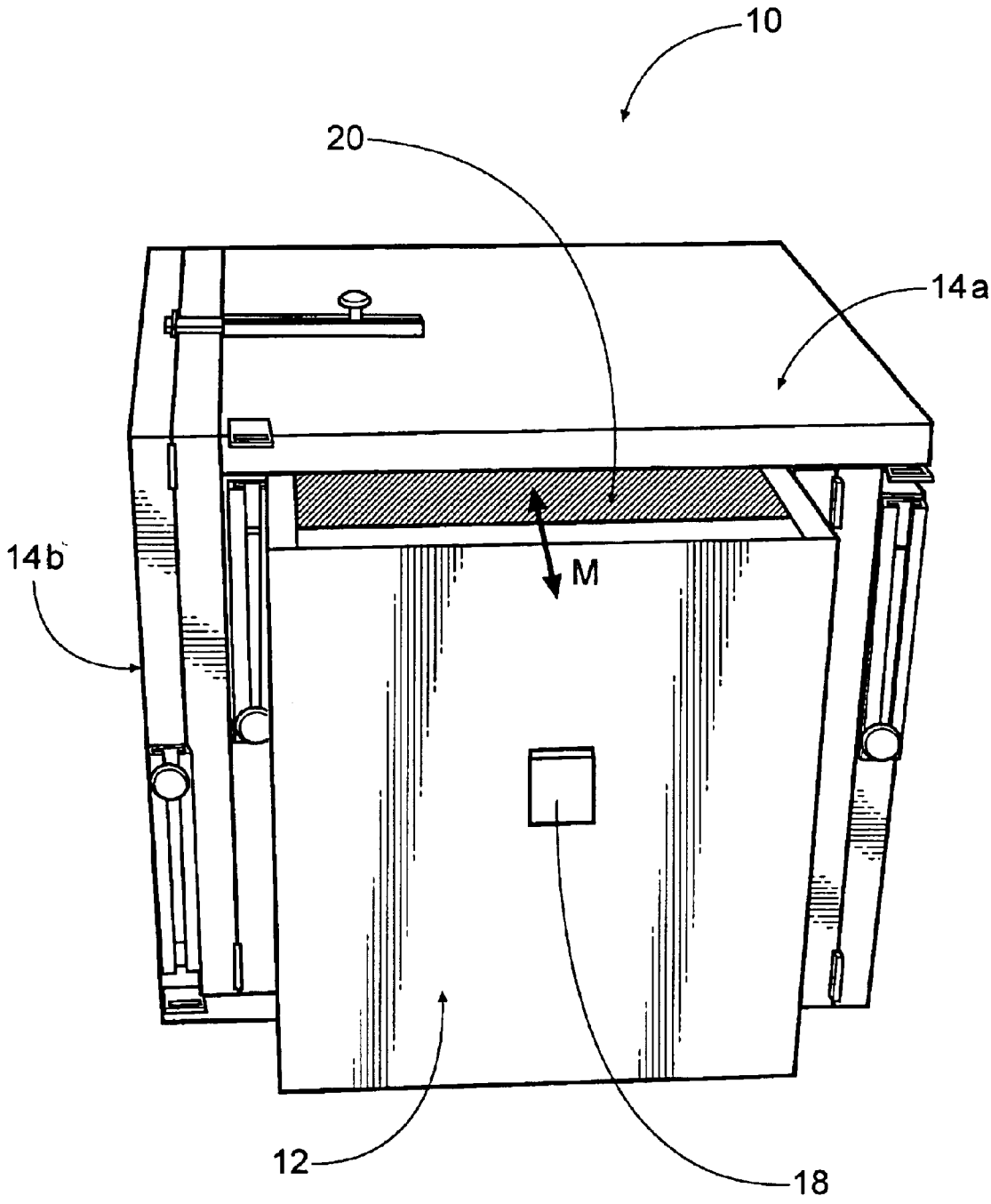
FIG. 2 is a perspective view of the modular furniture assembly according to FIG. 1 when a table is in a partially removed position.
Figure 3:
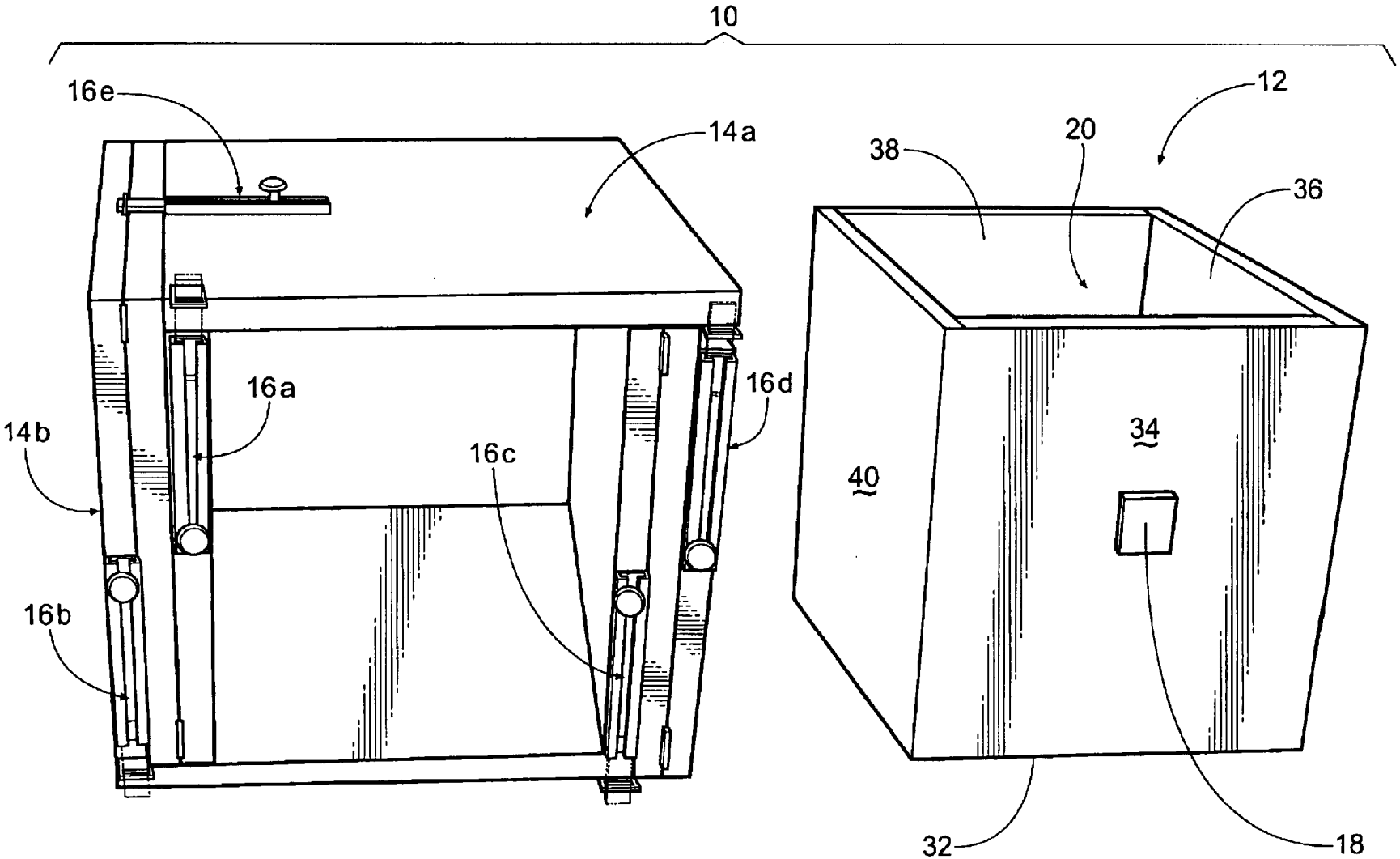
FIG. 3 is a perspective view of the modular furniture assembly according to FIG. 1 when the table is in a fully removed position and two chairs are shown attached together in the stowed position.
Figure 4:
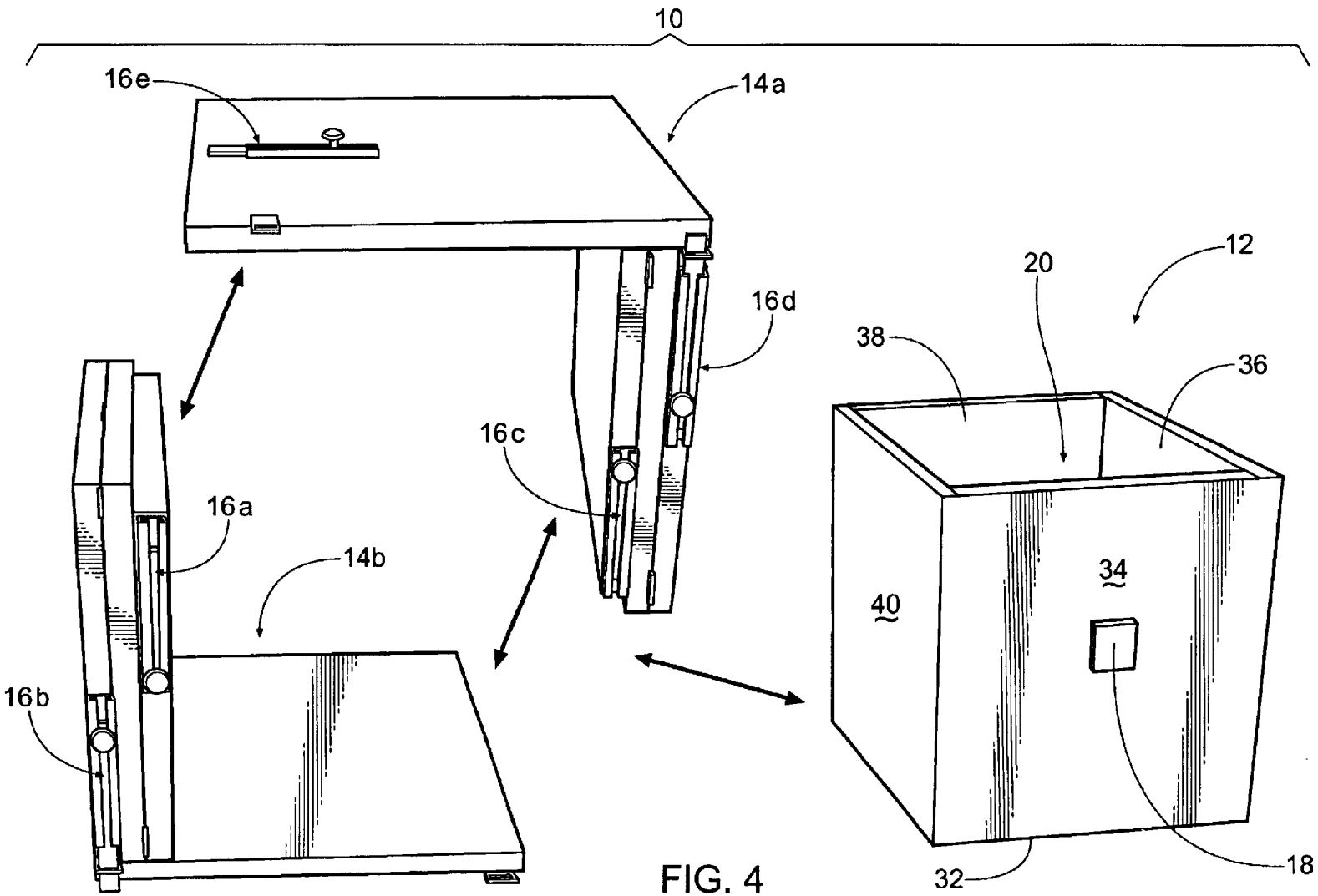
FIG. 4 is a perspective view of the modular furniture assembly according to FIG. 1 illustrating the two chairs in a separated, stowed position.

As seen in FIG. 2, to begin forming the furniture assembly 10, the table 12 is shown in a nested position and pulled outward, as illustrated by the arrow M, from the pair of attached chairs 14*a*, 14*b*. A knob 18 or other pull means may be included on the table 12 to facilitate removing of the table 12 from the pair of attached chairs 14*a*, 14*b*. Once the table 12 is completely removed from the pair of attached chairs 14*a*, 14*b* (FIG. 3), the chairs 14*a*, 14*b*, may be separated from each other by detaching the surface bolts 16*a*, 16*c*, and 16*e* (FIG. 4). The table 12 may comprise a plurality of solid surfaces 32, 34, 36, 38, 40, and a cavity 20 as a means for storing articles, such as toys, and art supplies, such as a smock, a tarp, paints, brushes, stencils, markers, sponges, stickers, and the like (not shown).

Figure 5:
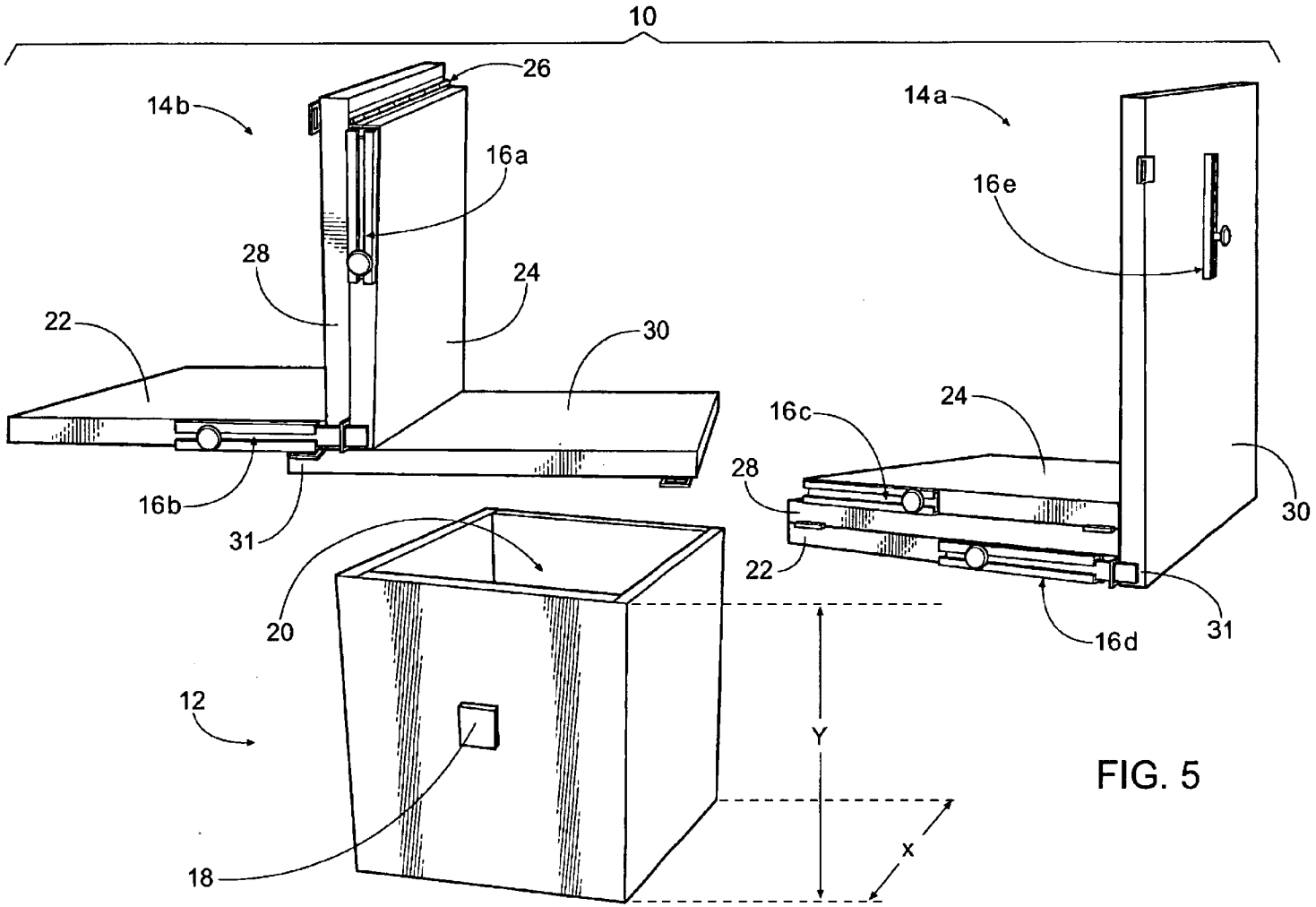
FIG. 5 is a perspective view of the modular furniture assembly according to FIG. 4 showing one of the chairs in a first, partially deployed position and the other chair in the stowed position.
Figure 6:
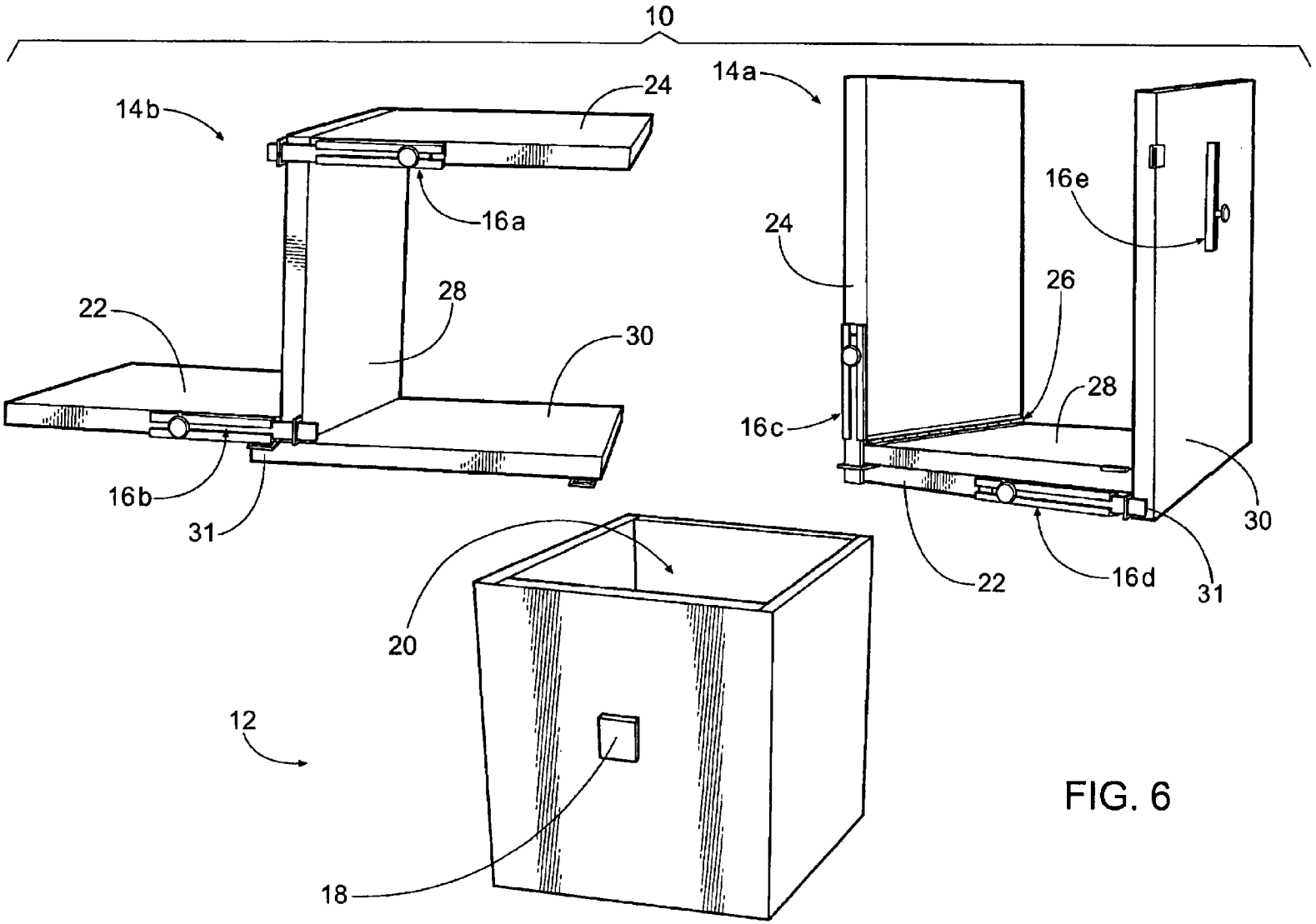
FIG. 6 is a perspective view of the modular furniture assembly according to FIG. 5 showing one of the chairs in a fully deployed position and the other chair in a first, partially deployed position.
Figure 7:
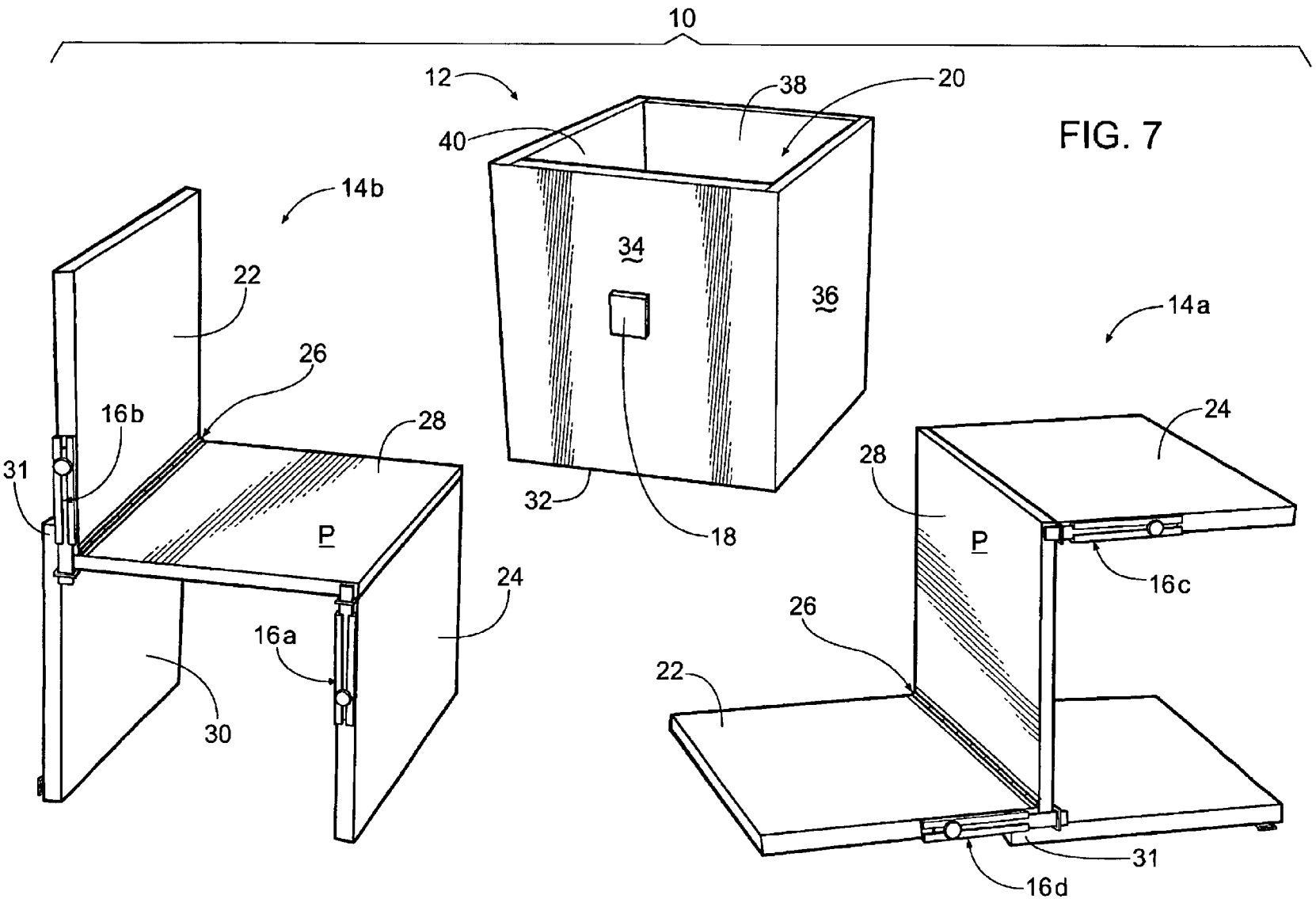
FIG. 7 is a perspective view of the modular furniture assembly according to FIG. 6 showing both of the chairs are in a fully deployed position.

Next, as shown in FIGS. 5–7, the pair of chairs 14*a*, 14*b*, can be deployed in an "open" position by detaching the surface bolts 16*b*, 16*d*, respectively. The detaching of surface bolt 16*b* facilitates deployment of the chair 14*b*, and the detaching of surface bolt 16*d* facilitates deployment of the chair 14*a*. Upon detaching the surface bolts 16*b* and 16*d*, a back 22 of each chair 14*a*, 14*b* can be unfolded by pivoting the back 22 about a seat 28. In similar fashion, a front leg 24 may be unfolded and pivoted about the seat 28 once the chairs 14*a*, 14*b*, are separated from each other by the detaching of the surface bolts 16*a*, 16*c*, and 16*e* as described above. Essentially, the back 22 and front leg 24 are pivoted about respective pivoting means, such as hinges 26. Each hinge 26 is located about each side of the seat 28.

As also shown in FIGS. 5–7, a rear leg 30 having a lip portion 31 is illustrated in a fixed relationship with the seat 28. The lip portion 31 is defined to include the portion of the rear leg 30 that extends past a plane, P (FIG. 7), defined by the top surface of the seat 28 when the chairs 14*a*, 14*b* are situated in an upright position. When the back 22 is deployed, the lip portion 31 of the rear leg 30 prevents the back from pivoting past a 90° pivot angle with respect to the seat 28. However, the lip portion 31 may also include a bezel (not shown) having a desirable angle that is referenced from the plane, P, of the top surface of the seat 28. The bezel may be desirably positioned in adjacent relationship to the back 22 so as to permit the back 22 to pivot and recline about the hinge 26 at an angle great than 90° with respect to the seat 28.

Figure 8:
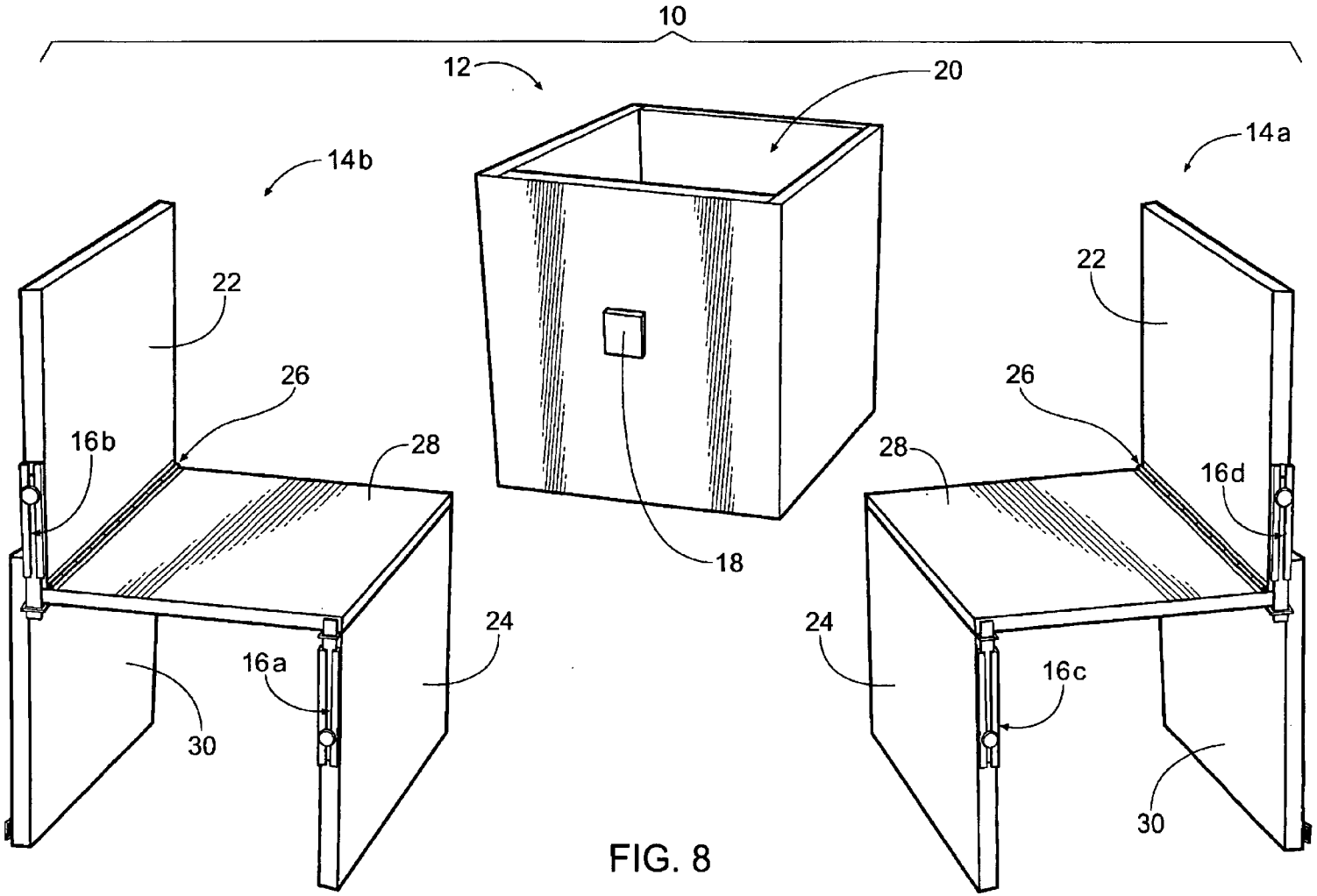
FIG. 8 is a perspective view of the modular furniture assembly according to FIG. 7 showing the table in an upward position, exposing a cavity and both chairs in an upright, fully deployed position.
Figure 9:
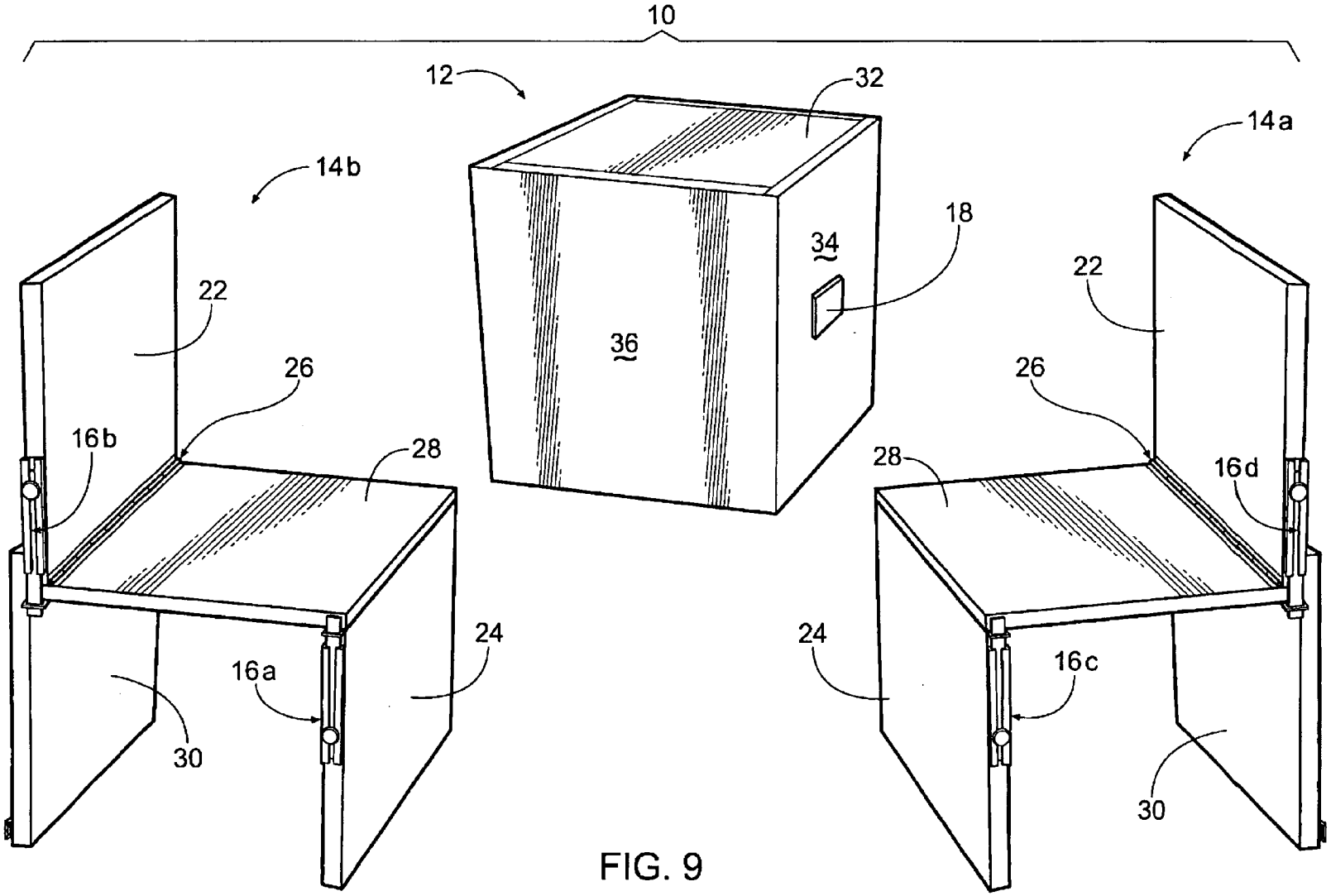
FIG. 9 is a perspective view of the modular furniture assembly according to FIG. 8 showing the table in an upside-down position, exposing a solid surface and both chairs in an upright, fully deployed position.

As best shown in FIGS. 8 and 9, after fully pivoting the front leg 24 and back 22 in a deployed position, the surface bolts 16*a*–16*d* are orientated in a locking relationship so that each chair 14*a*, 14*b* is rigidly secured for positioning in an upright seating arrangement. As shown in FIG. 9, the table 12 can be turned such that the solid surface 32 is facing upward, and the furniture assembly 10 can be used by children for various playtime activities, such as a tea party.

Figure 11:
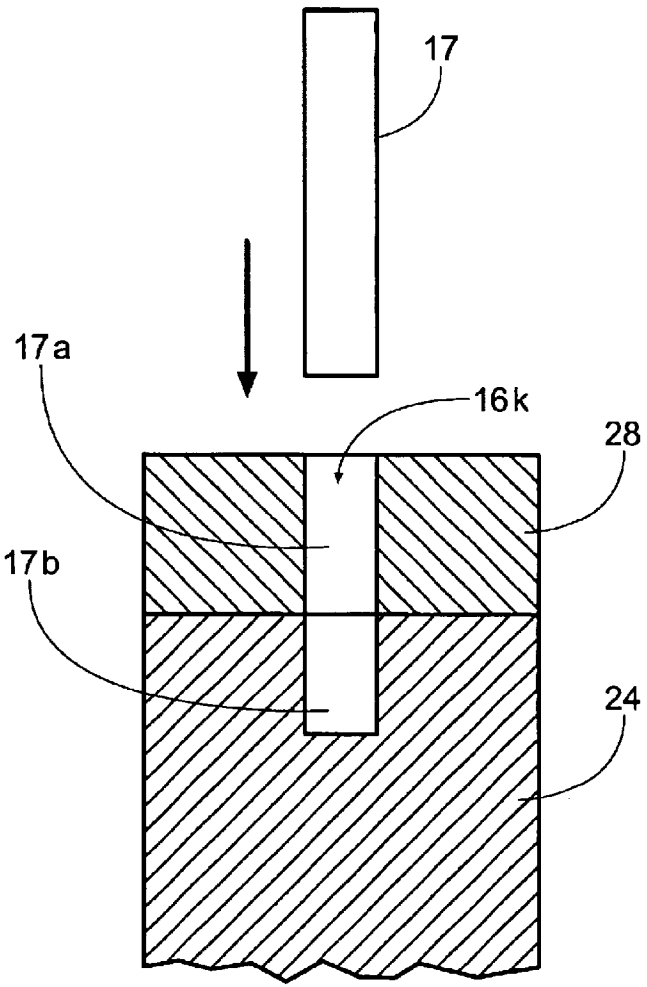
FIG. 11 is a cross-sectional view of a seat and front leg of the chair according to FIG. 10.
Figure 10:
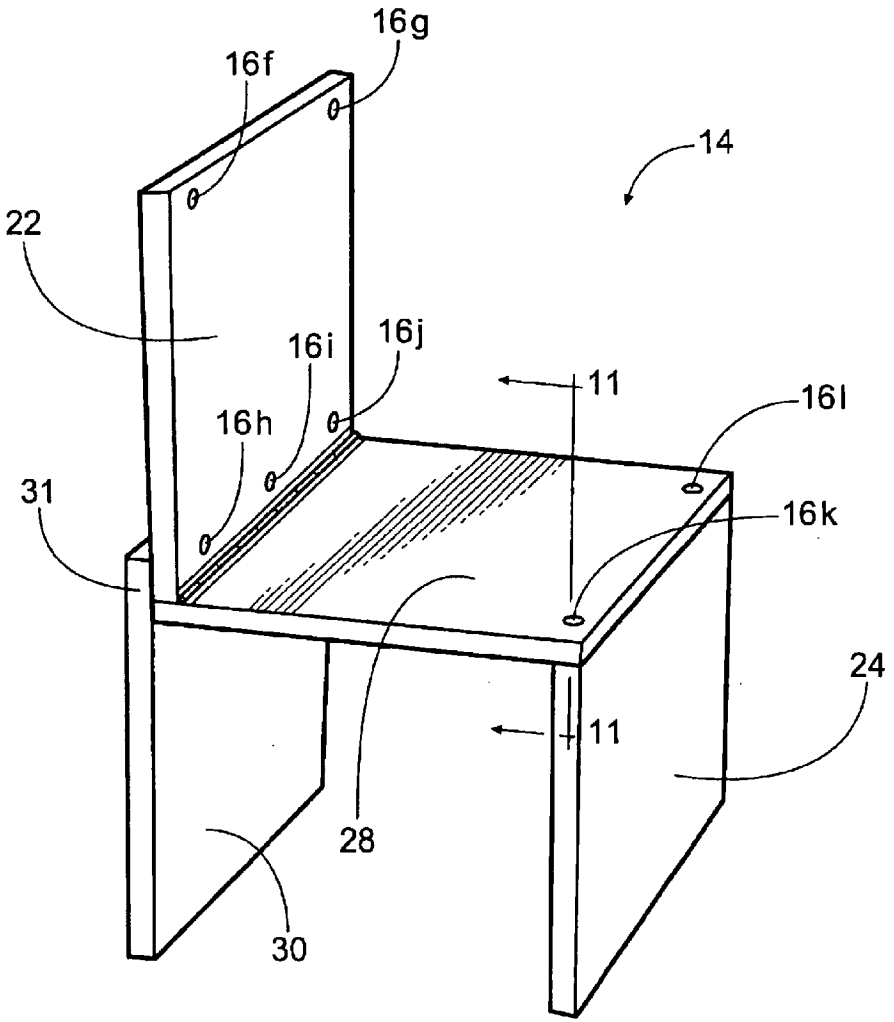
FIG. 10 is another embodiment of the modular furniture assembly showing a perspective view of a chair in an upright position.

Referring to FIGS. 10 and 11, the modular furniture assembly 10 may include another embodiment of the locking means that comprises a plurality of holes 16*f*–16*l* (FIG. 10) formed in a chair 14 for cooperation with a plurality of dowels 17 (FIG. 11). The deployment of the chair 14 with the holes 16*f*–16*l* from a "closed position" to an "open position" functions in a similar manner as described above in FIGS. 1–9 for the chairs 14*a*, 14*b*. Although only seven holes 16*f*–16*l* are shown in the illustrated view according to FIG. 10, any desirable amount of holes may be included in the design of the chair 14. The holes 16*f*–16*l* may be formed in the chair 14 with any desirable technique, such as for example, drilling, laser scoring, or with another similar forming method. Each hole 16*f*–16*l* is further defined to include a passage 17*a* and a receiving portion 17*b* (FIG. 11) that is adaptable to receive the dowels 17.

According to the illustrated view in FIG. 11, the passage 17*a* and receiving portion 17*b* described above is shown in greater detail for the hole 16*k*. As illustrated, the passage 17*a* extends through the seat 28 and the receiving portion 17*b* extending through a portion of the front leg 24. In this example, once the dowel 17 is fully passed through the passage 17*a* and received at the receiving portion 17*b*, the seat 28 and the front leg 24 are fixed in a locked relationship, and the pivotal movement of the front leg 24 about the seat 28 is prevented. In order to supplement the locking arrangement of the front leg 24 about the seat 28 at the hole 16*k*, another dowel is passed through the opposing hole 16*l*, which is located in the seat 28 and front leg 24.

In a similar fashion described above for the holes 16*k* and 16*l*, the back 22 is fixed in a locked relationship with the rear leg 30 at the holes 16*h*–16*j*. Passages 17*a* extend through the back 22 and receiving portions 17*b* extend through a portion of the rear leg 30. The holes 16*f* and 16*g*, which are shown near the top of the back 22, are provided so that dowels may lock the chair 14 in a stowed position, as seen in a similar fashion in FIGS. 1–4. Additional holes may also be included in the design of the chair 14 so that a pair of chairs 14 may be locked together, as shown in FIGS. 1–3 above.

During the various stages of deployment of the chair 14, some of the dowels 17 may not be used and stowed accordingly in the cavity 20 or at a remote location from the modular furniture assembly 10. Essentially, the use of the holes 16*f*–16*l* and the dowels 17 reduces costs and eliminates the need for extra materials for other locking means, such as the surface bolts 16*a*–16*e*. Even further, when the holes 16*f*–16*l* and dowels 17 are employed, the design of the modular furniture assembly 10 results in a less structural, visually pleasing appearance of the chair 14.

As described above, the modular furniture assembly 10 having an appearance of a geometric shape in a stowed, closed position may be transformed into a table 12 and chairs 14*a*, 14*b* when unlocked in a deployed, open position. This is accomplished by nesting the table 12 within the chairs 14*a*, 14*b* to give the appearance of the geometric shape, such as a cube. It should be noted that the seat 28, the back 22, and the front and rear legs 24, 30 of the chairs 14*a*, 14*b* have approximately the same height and width dimensions as the height and width dimensions, X, Y (FIG. 5), of the table 12 so that the table 12 can be nested within the chairs 14*a*, 14*b*. However, it will be appreciated that the invention is not limited by the "nesting" of the table 12 within the chairs 14*a*, 14*b* to form a geometric shape, but rather, the chairs 14*a*, 14*b* may be dimensioned such that the chairs 14*a*, 14*b* themselves may be "nested" within the cavity 20 of the table 12. It will also be appreciated that the invention is not limited by the number of chairs 14*a*, 14*b*, and that the invention can be practiced with any desired number of chairs 14*a*, 14*b* to form the assembly. Even further, although the invention is illustrated in a geometric shape comprising a cube, the invention can be practiced with any desired three-dimensional geometric shape, such as a pyramid, a faceted diamond, and the like.

While the invention has been specifically described in connection with certain specific embodiments thereof, it is to be understood that this is by way of illustration and not of limitation, and the scope of the appended claims should be construed as broadly as the prior art will permit.

What is claimed is:

1. A modular furniture assembly, comprising:

at least one chair capable of being folded into a closed position, and a table including a cavity, wherein the at least one chair is deployed from the closed position to an open position by unfolding the at least one chair;

wherein the table is stowed within an opening formed by the at least one chair when the at least one chair is in the closed position such that the modular furniture assembly forms a geometric shape when the table is stowed within the opening formed by the at least one chair;

a locking mechanism for locking the chair in the closed position; and wherein the locking mechanism prevents pivotal movement of one of a back and a leg of the chair when unfolding the chair from the closed position to the open position.

2. The modular furniture assembly according to claim 1, wherein the geometric shape is a cube.

3. The modular furniture assembly according to claim 1, wherein the cavity is adaptable for storing articles when the assembly is in the stowed position.

4. The modular furniture assembly according to claim 1, wherein a dimension of the at least one chair is approximately equal to a dimension of the table.

5. The modular furniture assembly according to claim 1, wherein the locking mechanism comprises one of a surface bolt and a dowel.

6. A modular furniture assembly, comprising:

at least one chair capable of being folded into a closed position, and a table including a cavity, wherein the at least one chair is deployed from the closed position to an open position by unfolding the at least one chair;

wherein the table is stowed within an opening formed by the at least one chair when the at least one chair is in the closed position such that the modular furniture assembly forms a geometric shape when the table is stowed within the opening formed by the at least one chair; and wherein the chair includes a rear leg having a lip portion, wherein the lip portion extends past a plane defined by a top surface of a seat to prevent a back from pivoting past a predetermined angle with respect to the seat.

* * * * *